US006817970B2

(12) United States Patent
Berit et al.

(10) Patent No.: US 6,817,970 B2
(45) Date of Patent: Nov. 16, 2004

(54) CENTRIFUGE FOR EXTRACTING INTERSTITIAL FLUID

(75) Inventors: Bradley I. Berit, Lawrenceville, NJ (US); Barry Bratcher, Owensboro, KY (US); R. Barry Holtz, Vacaville, CA (US)

(73) Assignee: Large Scale Biology Corporation, Vacaville, CA (US)

( * ) Notice: Subject to any disclaimer, the term of this patent is extended or adjusted under 35 U.S.C. 154(b) by 158 days.

(21) Appl. No.: 10/172,957

(22) Filed: Jun. 17, 2002

(65) Prior Publication Data

US 2003/0232711 A1 Dec. 18, 2003

(51) Int. Cl.[7] ..... B04B 1/12; B04B 7/08; B04B 15/06; B04B 15/08

(52) U.S. Cl. ..... 494/29; 494/37; 494/56; 494/61

(58) Field of Search ..... 494/1, 5, 23, 27–30, 494/37, 56, 61, 63; 95/261; 96/196

(56) References Cited

U.S. PATENT DOCUMENTS

| | | | | |
|---|---|---|---|---|
| 887,841 A | | 5/1908 | Peck | |
| 2,745,217 A | | 5/1956 | Gold et al. | |
| 3,161,593 A | | 12/1964 | Schiel | |
| 3,606,142 A | | 9/1971 | Westberg | |
| 3,818,974 A | | 6/1974 | Eberle | |
| 3,837,491 A | | 9/1974 | Humiston et al. | |
| 3,856,483 A | | 12/1974 | Rumpf et al. | |
| 3,893,894 A | | 7/1975 | Humiston | |
| 3,928,003 A | | 12/1975 | Fryer | |
| 4,196,844 A | | 4/1980 | Jacobson | |
| 4,286,748 A | * | 9/1981 | Bailey | 494/29 |
| 4,769,133 A | | 9/1988 | Brookes et al. | |
| 5,179,995 A | | 1/1993 | Limb | |
| 5,551,940 A | | 9/1996 | Cote | |
| 6,284,875 B1 | | 9/2001 | Turpen et al. | |

FOREIGN PATENT DOCUMENTS

| | | | |
|---|---|---|---|
| DE | 37 10137 A1 | | 10/1988 |
| GB | 121 325 A | | 6/1983 |
| JP | 355005719 A | | 1/1980 |
| JP | 411000582 A | | 1/1999 |
| JP | 2001-194491 | * | 7/2000 |

OTHER PUBLICATIONS

International Search Report—Form 210.*

* cited by examiner

*Primary Examiner*—Charles E. Cooley
(74) *Attorney, Agent, or Firm*—Waddey & Patterson. P.C.; Lucian Wayne Beavers

(57) ABSTRACT

A centrifuge is provided for recovering material of interest from the interstitial fluids of plant tissues. The centrifuge includes a rotatable centrifuge bowl having a radially outer wall inclined outwardly so that during centrifugation liquid in the bowl climbs the outer wall. The centrifuge bowl is contained in a vacuum sealed housing so that a material of interest contained in the bowl including said liquid can be subjected to a vacuum. A system for automated cleaning of the centrifuge is also provided.

29 Claims, 6 Drawing Sheets

CENTRIFUGE FOR EXTRACTING INTERSTITIAL FLUID

BACKGROUND OF THE INVENTION

1. Field of the Invention

The present invention relates generally to the field of protein production and purification. More specifically, the present invention relates to a centrifuge apparatus for use in methods for isolating concentrated, active proteins from the intercellular material of plants via a vacuum and centrifugation process which does not destroy the plant material, permitting secondary protein extraction from the plant material.

2. Description of the Prior Art

There are many examples of valuable proteins that are useful in pharmaceutical and industrial applications. Often these molecules are required in large quantities and in partially or highly purified formulations to maintain product quality and performance. Plants are an inexpensive source of proteins, including recombinant proteins. Many have proposed the desirability of producing proteins in large amounts in plants. However, the problems associated with extracting and processing products from homogenized plant tissues as well as purifying and recovering the recombinant protein product have been recognized as substantial. Austin et al. Annals New York Academy of Science, 721:234–244 (1994). These problems represent major impediments to successful recombinant protein production in plants on a large and commercially valuable scale.

Plant cells are thought to synthesize proteins on the membranes of the endoplasmic reticulum and transport the proteins synthesized to the cell surface in secretory vesicles formed at the Golgi apparatus. A discussion of the topic is provided by Jones et al., New Phytology, 111:567–597 (1989). Significant research has been devoted to elucidating the specific mechanisms related to protein secretion for several particular proteins in specific plant tissues or cell cultures. Examples of such efforts are presented by Herbers et al., Biotechnology 13:63–66 (1995), Denecke et al., The Plant Cell 2:51–59 (1990), Melchers et al., Plant Molecular Biology 21:583–593 (1993) and Sato et al., Biochemical and Biophysical Research Communications 211 (3):909–913 (1995). In the case of proteins not secreted into the plant cell apoplasm or intercellular space, a mechanism for lysing the plant cell wall must be utilized in order to release and capture the protein of interest. Plant cells must be exposed to very high shear forces in order to break the cell walls and lyse cellular membranes to release intracellular contents. Proteins of interest, whether recombinantly produced or naturally produced by the subject plant, are thereby exposed to a hostile chemical environment and are particularly subject to oxidative and proteolytic damage due to the exposure of the product to enzymes and small molecules that were compartmentalized before homogenization of the tissue. In addition, most of the-other total cellular protein is mixed with the protein of interest creating formidable purification problems if such a cell lysis procedure is performed.

In order to use the biosynthetic capacity of plants for reliable protein production, a process to obtain specific proteins that can be secreted into the intercellular space (apoplasm) of plant tissues is desirable. Such a procedure would forego the need for homogenization. If such a procedure is performed, the fraction of plant material containing one or more proteins of interest might be obtained without homogenization. Therefore, such a procedure provides that the plant extract is enriched for the particular protein of interest, and the protein is protected from some chemical and enzymatic degradation.

Since the valuable proteins and products of interest are partitioned or secreted into the interstitial spaces, vacuum pressure facilitates the introduction of infiltration medium into the interstitial space. Similarly, various forces can be applied to remove the retained fluid. Centrifugal force of 1,000 G is effective. Using gravity, the retained fluid can be collected in a trap under vacuum. With or without vacuum infiltration of a buffer, the enzyme can be recovered by freezing the tissue, thawing and applying a physical press to recover the fluid. However, such a procedure results in an undesirable increased cellular lysis.

Genetically modified plants are a reliable source for the production of recombinant proteins. Because the biological product is accumulated under nonsterile growth conditions and the production may be scaled to the quantities desired in a relatively inexpensive manner, it is feasible to exploit a dilute but enriched source such as the interstitial fluid fraction as a source for harvesting proteins of interest on an industrial scale. A variety of proteins of interest may be harvested from recombinant plant sources, however, highly active, pharmaceutical quality enzymes, cytokines and antibodies are particularly valuable products that can be developed by this process.

U.S. Pat. No. 6,284,875 to Turpen et al., and assigned to the assignee of the present invention, discloses methods for recovering proteins from the interstitial fluid of plant tissues, which method generally includes the steps of:

(1) submerging plant tissue in a predetermined fluid having a predetermined pH;

(2) subjecting the submerged plant tissue to vacuum pressure to release the interstitial fluid with minimal damage to cell walls within the tissue; and (3) centrifuging the plant tissue to draw interstitial fluid out of the plant tissue.

There is, however, a continuing need for improved apparatus to conduct processes like those of the Turpen et al. U.S. Pat. No. 6,284,875, and particularly there is a need for such apparatus which can be utilized on a repeated and automated basis. Many different processes involve sequential batch processing of different materials, such that cleaning of the production equipment between batches is necessary. For example, the production of patient-specific medicines requires a high speed automated process and requires the complete separation of the product of each batch processed, thus requiring a complete cleaning of the apparatus between batches.

SUMMARY OF THE INVENTION

The present invention provides a centrifuge apparatus for recovery of a material of interest from the interstitial fluid of plant tissues, which apparatus includes a rotatable centrifuge bowl for receiving plant tissue and a buffer solution. The apparatus further includes a vacuum sealable housing containing the centrifuge bowl, so that the plant tissue and buffer solution in the centrifuge bowl can be subjected to a substantially vacuum environment. The centrifuge bowl has a radially outwardly inclined outer wall so that interstitial fluid centrifuged from the plant tissue climbs the outer wall during centrifugation.

In another aspect of the invention the centrifuge apparatus includes a rotatable centrifuge bowl having a radially outer wall inclined outward so that during centrifugation, liquid in the bowl climbs the outer wall. The apparatus includes a vacuum sealed housing containing the rotatable centrifuge bowl so that a material of interest contained in the bowl and including the liquid can be subjected to vacuum.

In still another aspect of the invention the centrifuge apparatus includes a rotatable centrifuge bowl having a radially outwardly inclined outer wall. The apparatus further includes a housing containing the centrifuge bowl and at least one cleaning nozzle disposed in the housing and directed toward the centrifuge bowl for cleaning the centrifuge bowl. The at least one cleaning nozzle may include selective combinations of a first nozzle directed toward an interior of the bowl, a second nozzle directed toward a central exterior surface of the bowl, and a third nozzle directed to an annular space between the bowl and the housing.

In another aspect of the invention methods are provided for recovering a material of interest from the interstitial fluid of plant tissues, wherein the plant tissue is placed in a centrifuge, the centrifuge is sealed, a buffering solution is introduced, a vacuum is created in the centrifuge thereby allowing the buffering solution to infiltrate the plant tissue, and the centrifuge is rotated thereby drawing the buffering solution and the material of interest out of the centrifuge.

And in another aspect of the invention an annular centrifuge bowl includes a cup shape receptacle located above a central space surrounded by the bowl. The receptacle includes apertures which feed cleaning fluid into the central space to clean the surfaces of the bowl surrounding the central space.

Accordingly, it is an aspect of the present invention to provide an improved apparatus and methods for centrifuging materials in a vacuum environment.

Another object of the present invention is the provision of a centrifuge apparatus and methods for recovery of a protein of interest from the interstitial fluid of plant tissues, which apparatus includes a centrifuge bowl having a radially outwardly inclined outer wall for aiding the removal of the interstitial fluids from the centrifuge bowl.

And another object of the present invention is the provision of a centrifuge apparatus and methods having internal cleaning nozzles arranged for automated cleaning of the centrifuge apparatus between batches of material being processed.

Other and further objects, features and advantages of the present invention will be readily apparent to those skilled in the art upon a reading of the following disclosure when taken in conjunction with the accompanying drawings.

DETAILED DESCRIPTION OF THE PREFERRED EMBODIMENT

Figure 1:
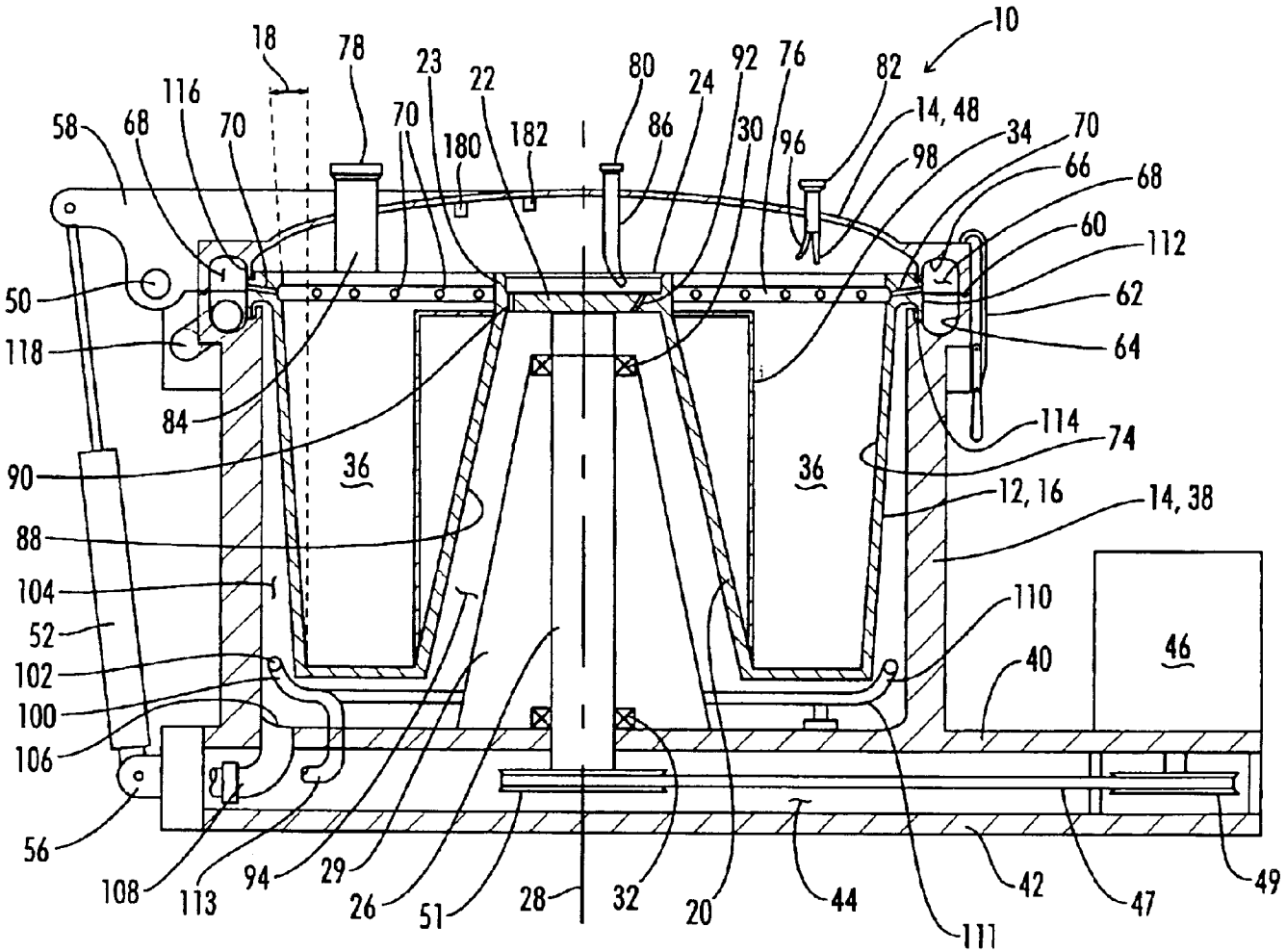
FIG. 1 is an elevation sectioned view of the centrifuge apparatus.
Figure 2:
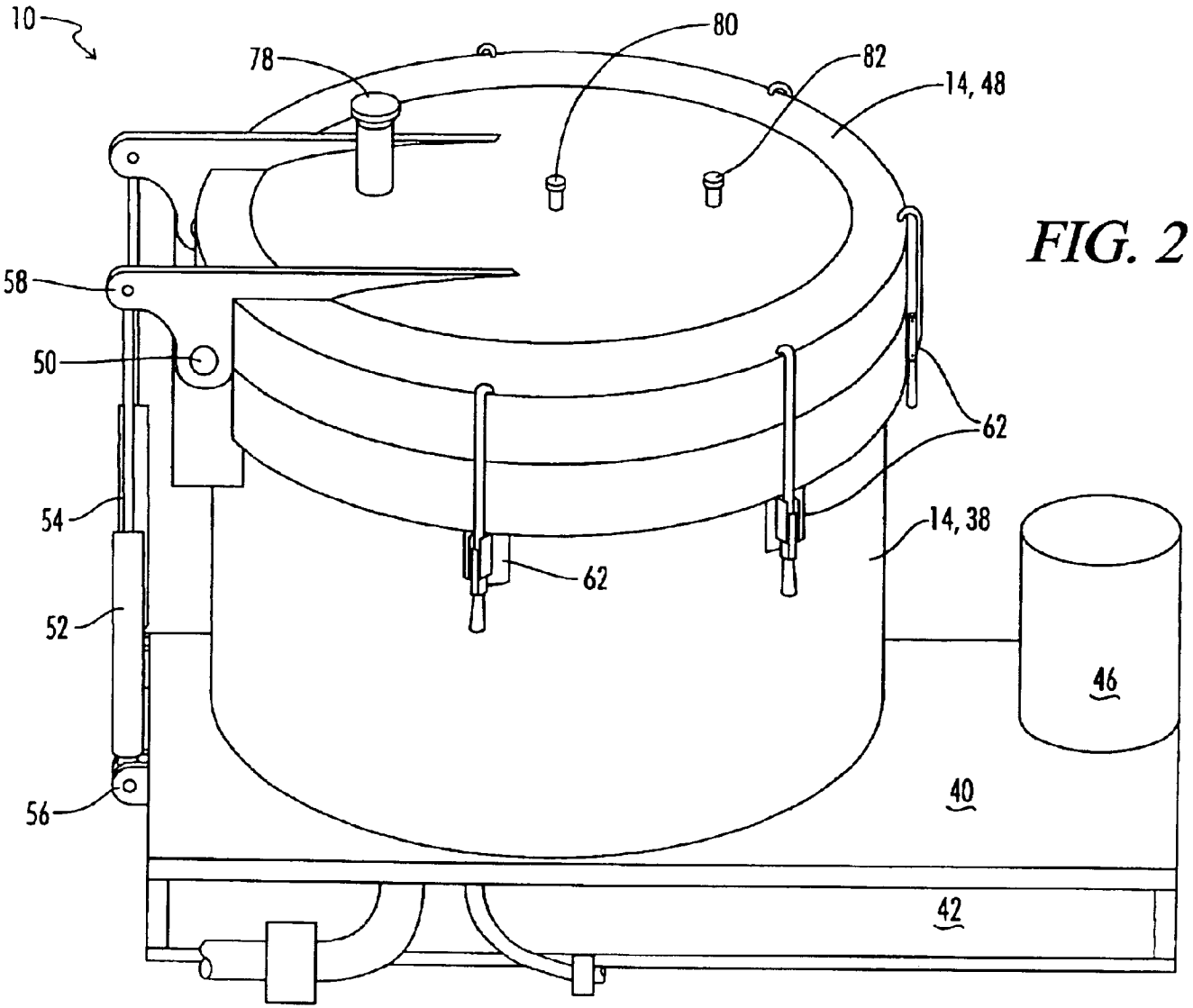
FIG. 2 is a perspective external view of the centrifuge apparatus.

A process and certain apparatus for recovering proteins from the interstitial fluid of plant tissue is disclosed in U.S. Pat. No. 6,284,875, assigned to the assignee of the present invention, the details of which are incorporated herein by reference.

The present invention deals generally with apparatus for implementing the large scale recovery of proteins and other materials of interest from the interstitial fluid of plant tissues, as described in U.S. Pat. No. 6,284,875. More particularly, the present invention provides apparatus for performing the process in connection with repeated batches, sometimes smaller in quantity.

One such situation is the production of patient specific medicines. As will be understood by those skilled in the art, when developing patient-specific vaccines and other medications, it is necessary to isolate the live plants from which the medications will be obtained, and it is also necessary to process the plants associated with each individual patient in separate batches. Furthermore, when preparing a large number of such patient-specific medications, it is necessary to rapidly and efficiently clean the apparatus between batches.

The invention is also useful in high-throughput production and purification of large numbers of separate proteins and/or macromolecules produced in plant tissue. Also, there are many applications for production of large numbers of different proteins, for instance for the subsequent production of antibodies for use in microarray applications (so called protein chips).

Accordingly, the present invention provides a system which is particularly suited for performing the process of U.S. Pat. No. 6,284,875 on a large number of individual batches of materials, and to provide automated cleaning of the apparatus between batches so that the multiple batch processes can be performed in a rapid and economical manner.

Turning now to the drawings, a centrifuge apparatus is shown and generally designated by the numeral 10. The apparatus 10 includes a rotatable centrifuge bowl 12 disposed in a housing generally designated by the numeral 14. The centrifuge bowl 12 has a radially outer wall 16 inclined radially outward at an angle 18 so that during centrifugation, liquid in the bowl 12 climbs the outer wall 16.

The angle 18 is preferably in the range of from 1–10°, more preferably in the range of from about 2–6°, and most preferably is about 5°.

The centrifuge bowl 16 further includes a radially innermost tapered wall 20 the upper end of which is closed by a mounting plate 22. An upwardly open cup or receptacle 24 is defined on top of the mounting plate 22 for use in the automated cleaning procedure as further described below. Walls 16 and 20 may also be referred to as radially outer and inner exterior walls, respectively.

The mounting plate 22 may be described as a bottom of cup 24. The cup 24 also includes an outer cup wall or receptacle wall 23 which extends upward as an extension of the radially inner wall 20.

The mounting plate 22 is attached to the upper end of a rotatable shaft 26 having a substantially vertical axis of rotation 28. The axis 28 may also be referred to as a bowl axis 28. The shaft 26 is mounted in a tower portion 29 of housing 14 by spaced bearings 30 and 32.

The centrifuge bowl 12 further includes a radially inner false wall 34 so that an annular bowl main chamber 36 is defined between the inclined radially outer wall 16 and the radially inner false wall 34. Chamber 36 is generally toroidal in shape. The radially inner false wall 34 is oriented substantially vertically which makes it substantially parallel to the bowl axis 28. The purpose of the false wall 34 is to reduce the internal volume of the main chamber 36 as contrasted to what the volume would be between the inclined outer wall 36 and the conically tapered innermost wall 20 in the absence of false wall 34, thus reducing the amount of buffering solution which is needed. The false wall 34 is not necessarily a structural member, but could alternatively be utilized as a structural member.

Housing 14 includes an outer housing 38 supported from a floor plate 40 which is in turn supported from a spaced base plate 42. The floor plate 40 and base plate 42 are spaced apart to provide hollow cavity 44 therebetween. A drive motor 46 is mounted on floor plate 40 and drives shaft 26 via belt 47 and pulleys 49 and 51.

Housing 14 further includes a lid 48 pivotally attached to outer housing 38 at pivot point 50.

Hydraulic or pneumatic rams 52 and 54 are connected between the outer housing 38 and the lid 48 to pivot the lid 48 between open and closed positions relative to the outer housing 38. Other types of mechanical actuators could also be used. First ram 52 is connected between lugs 56 and 58 connected to the outer housing 38 and the lid 48, respectively. Second ram 54 is similarly connected.

An annular O ring seal 60 is provided between outer housing 38 and lid 48. A plurality of clamps 62 provide a tight sealing engagement between outer housing 38 and lid 48 so that an internal vacuum may be maintained within the housing 14 as further described below.

The outer housing 38 and lid 48 each have defined therein annular grooves 64 and 66, respectively, which taken together define an annular collection chamber 68 when the lid 48 is in its closed position as shown in FIG. 1. An inclined inner surface 74 has a shallow inner groove 76 defined near the upper end thereof. Ports 70 communicate the shallow groove 76 with the annular collection chamber 68.

Thus, as the centrifuge 10 is operated, liquid contained in the annular main chamber 36 will flow up the inclined inner surface 74 due to the centrifugal forces acting thereon and those fluids will eventually flow through the radial ports 70 into the annular collection chamber 68.

The centrifuge bowl 12 includes a radially outward extending and downwardly directed annular flange 112, the lower edge of which extends into an annular groove 114 defined in the outer housing 38. The flange 112 is relatively closely spaced from housing 38 adjacent groove 114 and from an inner lip 116 of lid 48, but the flange 112 does not actually touch either the outer housing 38 or lid 48. This relatively close fit, however, does aid in keeping the liquid which is collected in annular chamber 68 within the annular chamber 68. The liquid collected in annular chamber 68 is drained therefrom by outlet pipe 118 which directs the extracted fluid to a separate container (not shown). The outlet pipe 118 is fitted with a valve (not shown) to enable creation of a vacuum within the interior of centrifuge 10. A vacuum pump (not shown) is connected to outlet pipe 118 to create the vacuum.

The lid 48 is formed with a plurality of sealable openings 78, 80 and 82. The first sealable opening 78 is connected to an inlet nozzle 84 which allows for the introduction of processing fluid into the chamber 36. The processing fluid may for example be a pH adjusted fluid that interacts with tobacco leaves processed in the centrifuge, as described in greater detail in U.S. Pat. No. 6,284,875. The sealable first opening 78 may also receive a suction tube (not shown) for drawing air from the annular chamber 36 to create a vacuum therein.

The second sealable opening 80 located approximately in the center of lid 48 has connected thereto a nozzle 86 for spraying cleaning solution into the centrifuge. The lower end of nozzle 86 is directed into the cup 24.

The innermost wall 20 may be described as a radially innermost upwardly tapered structural wall 20 for supporting the centrifuge bowl 12 from the support shaft 26. The wall 20 has a radially innermost surface 88 which may be described as a downward facing radially inner exterior tapered surface 88 of the centrifuge bowl 12.

Passages or apertures such as 90 and 92 are defined through mounting plate 22 and communicate the cup 24 and thus the nozzle 86 with the exterior surface 88 of bowl 12, and with an annular space 94 defined between the bowl 12 and the tower portion 29 of housing 14.

Thus, during a cleaning process, which is further described below, cleaning fluid exits nozzle 86 into cup 24 and flows through passages 90 and 92. The cleaning fluid flowing through passage 90 is particularly directed to the surface 88 and will tend to clean the same. Fluid flowing through passage 92 is generally directed to the annular space 94 between bowl 12 and tower portion 29 of housing 14 to clean the same. Annular space 94 may also be referred to as a central space 94 surrounded by centrifuge bowl 12.

As cleaning fluid is sprayed from the nozzle 86, the fluid collects in the cup 24 and slowly leaves the cup 24 due to gravity and centrifugal forces (if rotating) through the apertures 90 and 92. If the centrifuge is rotating as the cleaning fluid is sprayed from the nozzle 86, the rotation of the plate 22 causes the fluid flowing through the apertures 90 and 92 to accelerate thereby providing a further spraying action on the inner surfaces of the wall 20 ensuring adequate cleaning of those surfaces.

Figure 8:
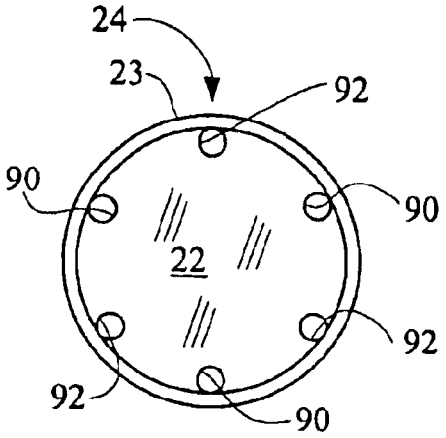
FIG. 8 schematically illustrates a plan view of the apertures in the central cup shape recess.

For most cleaning applications, with the centrifuge rotating at about 500 rpm, the apertures 90 and 92 create a pressure of 2 psi (for fluid being expelled from the apertures 90 and 92). Also, with the centrifuge rotating at about 1000 rpm, fluid leaving the lower end of the apertures 90 and 92 are under about 7 psi. There is no specific speed at which to rotate the centrifuge for effective cleaning, rather the 2 rpms and psi's given are a guide to the type of pressures possible on cleaning fluid being fed into the cup 24 as that fluid exhausts through the apertures 90 and 92. The apertures 90 are straight (vertical) elongated passages oriented parallel to the axis of rotation of the centrifuge bowl 12. The apertures 92 are inclined elongated passages oriented at an acute angle to the axis of rotation of the centrifuge bowl 12. In the depicted embodiment, there are three apertures 90 and three apertures 92. The apertures 90 and 92 are circumferentially spaced about the cup 24. The distribution of apertures 90 and 92 is schematically shown in FIG. 8. Also as seen in FIG. 8, the apertures 90 and 92 are preferably located closely adjacent the cup wall 23. However, the number of apertures 90 and 92 is not limited to a total of 6, but more or fewer holes are also contemplated.

The third sealable opening 82 shown in FIG. 1 is connected to two nozzles 96 and 98, again for cleaning purposes.

A third cleaning nozzle 100 extends up from the floor plate 40 of housing 14 and has an outlet end 102 directed into an annular space 104 between the outer wall 16 of centrifuge bowl 12 and the outer housing 38. Thus cleaning fluid from outlet 102 is sprayed into the annular space 104 to aid in cleaning the annular space 104 and the exterior of centrifuge bowl 12 as further described below. Additional cleaning nozzles constructed similar to nozzle 100 may be located about the annular space 104 including for example nozzle 110. Any suitable number of such nozzles may be selected so that with their design spray pattern complete cleaning of the annular space 104 will be effected. The nozzle outlets 100 and 110 may be part of a spray ring 111 to which cleaning fluid is provided by spray ring inlet pipe 113.

Floor plate 40 has a drain outlet 106 defined therein which leads to a drain pipe for draining cleaning fluid from the interior of housing 38.

Each of the sealable openings 78, 80 and 82 includes either a sealing cap (not shown) or a valve (not shown) to withstand the vacuum pressures generated as air is drawn out of the inside of the centrifuge 10. Typically vacuums applied to centrifuge 10 is a complete vacuum of approximately 760 mm.

Operation of the Centrifuge

The operation of the centrifuge 10 to recover concentrated and active proteins or other materials of interest from the interstitial fluid of plant tissues is generally as follows.

Many different plant hosts may be infected with a modified virus to produce desired target proteins. The centrifuge 10 may be used to extract molecules from any of a variety of plant tissues. Tobacco is just one example of the type of extraction possible using the centrifuge 10. In one example, the tobacco mosaic virus is genetically manipulated, but other viruses may be similarly modified. Further, transgenic, transfected or non-modified viruses may be utilized to infect any of a variety of plant tissues in addition to tobacco. As well, transgenic plants may be processed for extraction of desired molecules.

This process is described herein in connection with the recovery of such proteins from tobacco plants which have been infected with a genetically altered tobacco mosaic virus, but as noted above, the process may also be used with other plant tissues. After genetically manipulating the virus, an acreage of tobacco plants is infected in order to produce proteins that will be subsequently used for vaccines, medicines and the like.

The harvested tobacco leaves containing the material of interest within the leaf structure of the plant are inserted into a mesh bag or series of mesh bags. The mesh bag or bags are then inserted into the annular cavity 36 of centrifuge bowl 12, and the lid 48 of the centrifuge 10 is closed and sealed.

Figure 6:
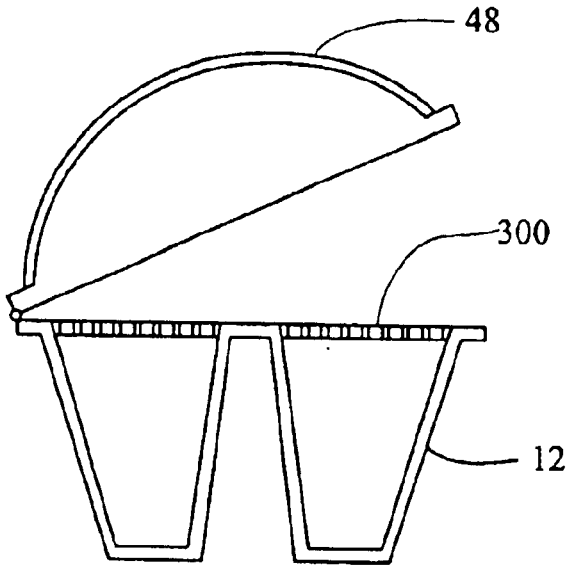
FIG. 6 schematically illustrates an alternative embodiment using a mesh screen over the centrifuge bowl to retain solid material.
Figure 7:
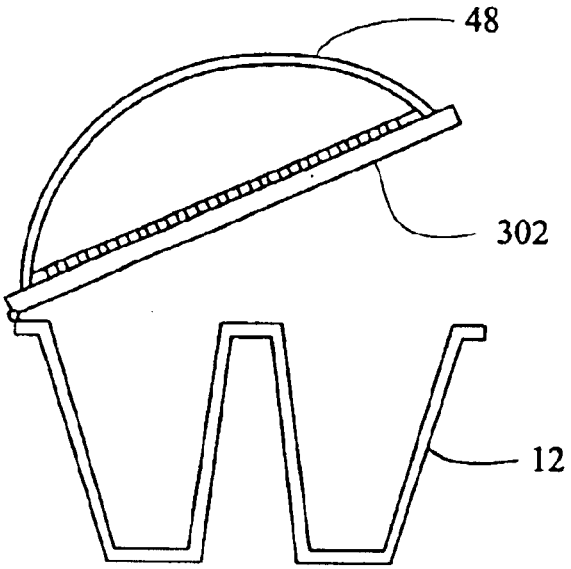
FIG. 7 schematically illustrates an alternative embodiment using a mesh screen carried by the lid to retain solid material.

Instead of using mesh bags, a mesh screen may be fixed to either the housing or to the outer perimeter of the bowl thereby retaining solid material placed in the centrifuge bowl. With a mesh screen fixed to the bowl or housing, no mesh bag is necessary. FIG. 6 schematically illustrates a mesh screen 300 placed over bowl 12. FIG. 7 schematically illustrates a mesh screen 302 carried by lid 38.

A buffering solution such as the pH adjusted buffering fluid described in U.S. Pat. No. 6,284,875 is then introduced into the bowl 12 of centrifuge 10 via the first sealable opening 78 and the inlet nozzle 84. A vacuum is then created in the centrifuge 10, preferably by drawing a vacuum via the outlet pipe 108 connected to a vacuum pump (not shown), thus allowing the buffering liquid to act upon the leaves in the presence of the vacuum, again as is described in detail in U.S. Pat. No. 6,284,875. This vacuum may be released and reintroduced several times, depending upon the nature of the material of interest in the tobacco leaves.

After vacuum pressure is applied to the plant material and buffer solution, liquid is slowly spun out of the bowl 12 and discarded or recycled. This discarded liquid is excess buffer solution that did not infiltrate the plant tissue and, therefore, likely does not have the "product" or desired protein in it.

Next the bowl 12 of the centrifuge 10 is rotated at high speed by motor 46 to generate a force of approximately 3,000 G. During centrifugation, the buffering liquid and material of interest are drawn out of the centrifuge by allowing the same to climb the inner inclined wall 74 to the groove 76 where they pass through the openings 70 into the annular collection chamber 68 from which they are directed via outlet pipe 118 to a separate storage chamber (not shown). The tobacco leaves and mesh bags are then removed from the centrifuge 10 and the centrifuge 10 is automatically cleaned.

Alternatively it is noted that the mesh bag may have a doughnut or annular shape such that a single bag corresponding in dimensions to the annular chamber 36 may be used in the centrifuge. The doughnut shaped mesh bag is sized and shaped to conform to the inner dimensions of annular chamber 36.

In general, the methods for recovery of the material of interest from the interstitial fluid of plant tissues which is performed by the centrifuge 10 of the present invention may be described as including the steps of:

(a) placing the plant tissue in a centrifuge;

(b) sealing the centrifuge;

(c) introducing a buffering solution into the centrifuge;

(d) creating a vacuum in the centrifuge and thereby allowing the buffering solution to infiltrate the plant tissue;

(e) rotating the centrifuge at a predetermined slower rate sufficient to remove portions of the buffering solution that did not infiltrate the plant tissue; and (f) rotating the centrifuge at a higher rate and thereby drawing the buffering solution that infiltrates the plant tissue along with the material of interest out of the centrifuge.

As noted steps (c) and (d) may be repeated prior to steps (e) and (f).

This process differs in several ways from those described in U.S. Pat. No. 6,284,875. The vacuum is created in the centrifuge, rather than in a separate vacuum/buffering vessel. The buffering solution also is introduced into the centrifuge, rather than in the separate vacuum/buffering vessel. Also the bulk of the buffering solution must be withdrawn from the centrifuge, rather than from the separate vacuum/buffering vessel upstream of the centrifuge.

Automated Cleaning of the Centrifuge

As noted, the centrifuge 10 is designed to provide for automated cleaning thereof between batch operations.

The nozzles such as 100 and 110 spaced about the lower portion of the bowl 12 and directed into the annular space 104 provide for cleaning of the underside of bowl 12 and the annular space 104.

The nozzle 86 located near the center of lid 48 sprays cleaning fluid into the cup structure 24.

The vertically oriented apertures such as 90 and the angled apertures such as 92 direct the cleaning fluid to the downward facing surface 88, the tower 29, and the annular space 94 therebetween so as to clean those central portions of the centrifuge 10 outside of the bowl 12. The nozzles 96 and 98 are directed to the interior of the bowl 12, with nozzle 96 particularly directed to the vertical wall 34 and nozzle 98 particularly directed to the inclined surface 74.

Thus the cleaning fluid directed through nozzles 100, 110, 86, 96 and 98 can rinse any and all contamination from both inside the bowl 12 and outside the bowl 12 within the housing 38 of the centrifuge 10. The cleaning fluid is collected via outlet 100 and outlet pipe 108 and carried away from the housing 38 after cleaning.

The centrifuge 10 may be entirely constructed of stainless steel or other cleanable material. Further, it is noted that the seals in the underside of the centrifuge bowl 12 and on the lid 48 of the housing are positioned such that the "product" (the extracted buffer solution and material of interest) never contact the seals. Thus the seals need not be cleaned with the vigor that other surfaces may need to be cleaned.

Figure 3:
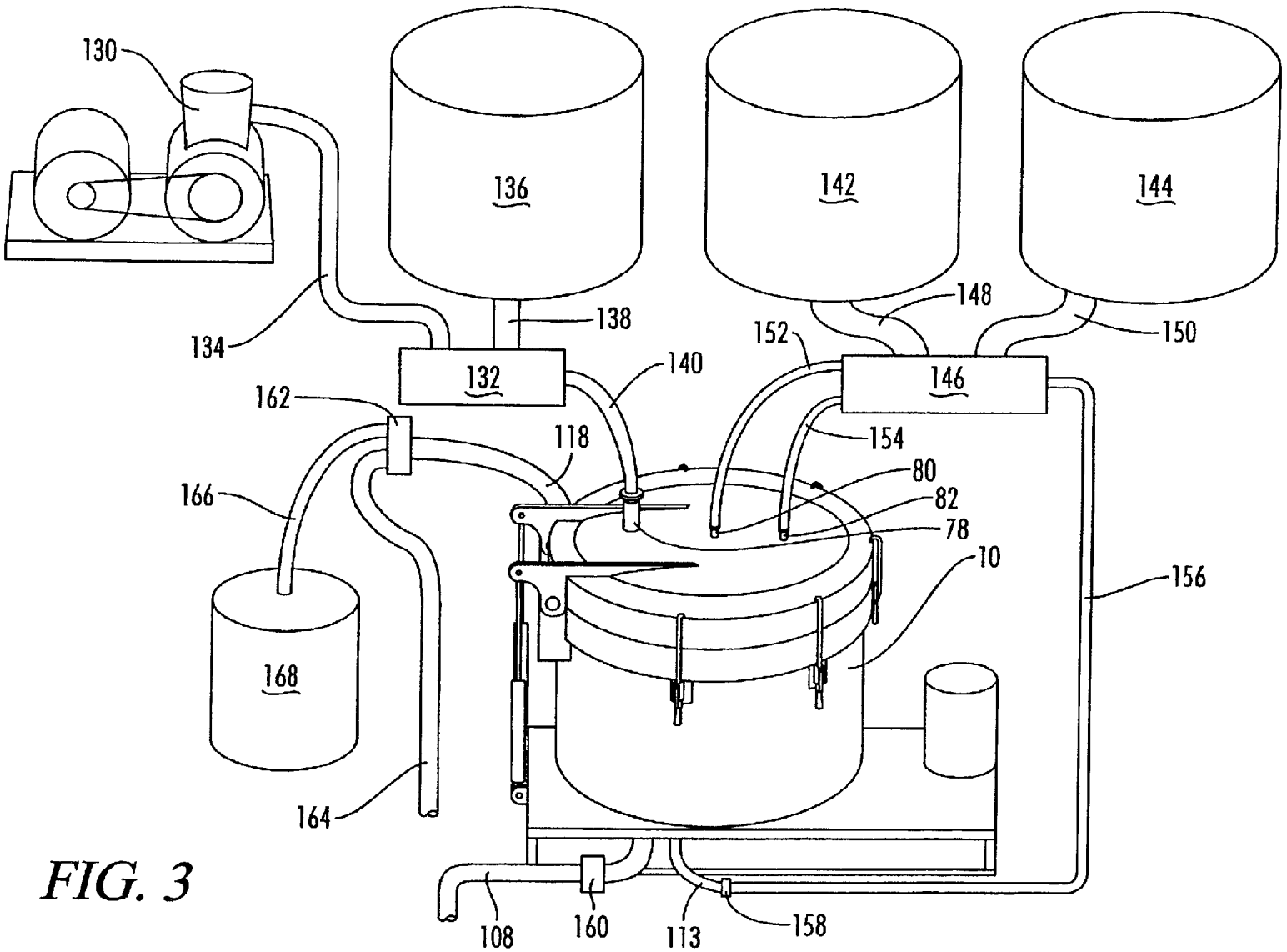
FIG. 3 is a schematic perspective view showing the centrifuge, supply tanks and flow control valve utilized to automate the cleaning of the centrifuge.

Referring now to FIG. 3, the centrifuge 10 is shown in association with various supply tanks and downstream tanks along with various control valves and the like utilized to automate the process of operating and cleaning the centrifuge 10. In FIG. 3, a vacuum pump 130 is connected to a first manifold valve 132 via vacuum line 134. Manifold valve 132 is connected to an extract buffer storage tank 136 via conduit 138. First manifold valve 132 is connected to the inlet 78 of centrifuge 10 via conduit 140. As is further described below, the first manifold valve 132 functions to place inlet 78 in communication with vacuum from pump 130, and alternatively first manifold valve 132 can communicate the buffer storage tank 136 with inlet 78 to fill the centrifuge 10 with buffering solution.

Cleaning solution storage tank 142 and rinse solution storage tank 144 are connected to a second manifold valve 146 via conduits 148 and 150. The second manifold valve 146 is in turn connected to inlets 80, 82 and 113 by conduits 152, 154 and 156. As will be further described below, the second manifold valve 146 functions to selectively direct either cleaning solution or rinse solution to the nozzles 86, 96, 98, 102 and 110.

A third manifold valve 158 is provided in conduit 156 connected to inlet 113 for selective cleaning of the underside of bowl 12 of centrifuge 10.

A fourth valve 160 is placed in drain pipe 108 to ensure a vacuum seal during evacuation of the centrifuge 10.

A fifth manifold valve 162 is connected to outlet pipe 118 for drawing off fluid exiting the centrifuge 10. The fifth manifold valve 162 is connected to a waste drain pipe 164 and to a conduit 166 leading to an interstitial fluid storage tank 168. The fifth manifold valve 162 is adjustable to three possible settings. In the first setting a vacuum may be maintained in the centrifuge 10 in which case manifold valve 162 is closed. In a second case when the centrifuge 10 is first run at a slow speed, excess solution exhausts from the centrifuge 10 through the waste drain pipe 164. In a third setting, when the centrifuge 10 is operated at a high rate of speed, the extracted interstitial fluid is fed to the interstitial fluid storage vessel 168.

Figure 4:
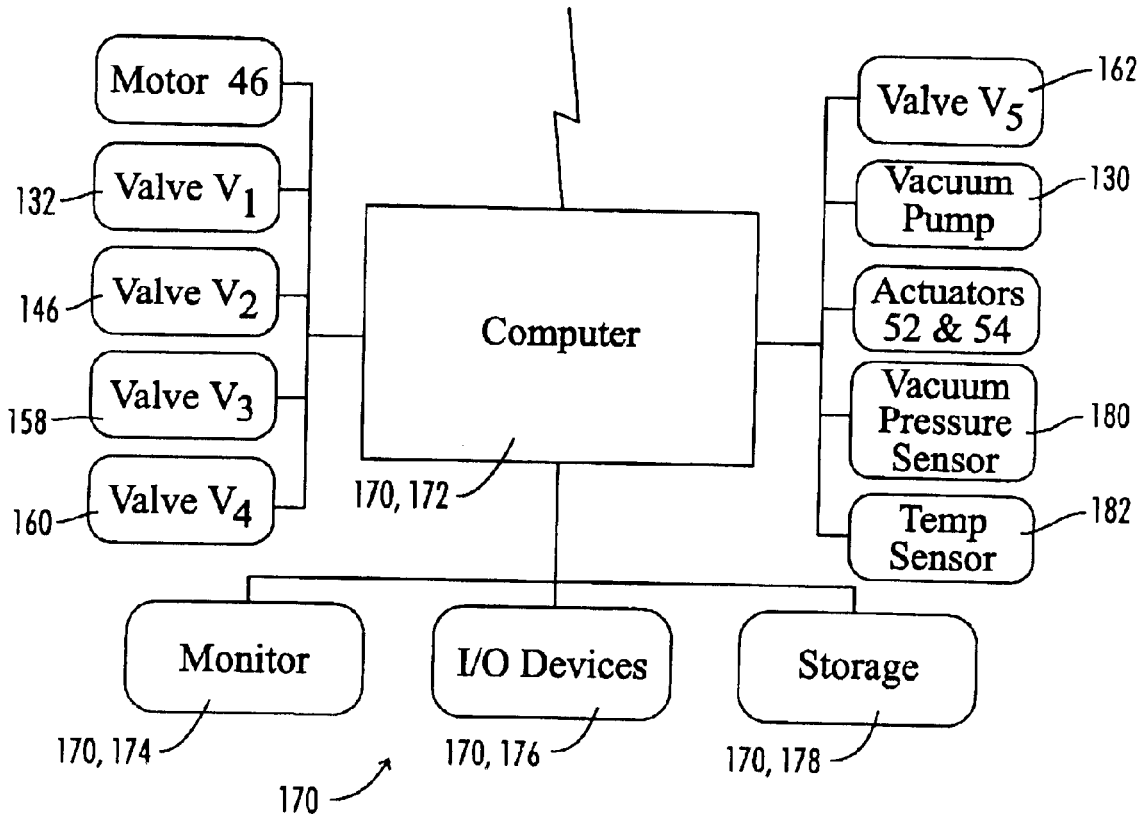
FIG. 4 is a block diagram showing a computerized control system connected to the flow control valves and sensors on the centrifuge for automated control of the centrifuge.

FIG. 4 schematically illustrates a computerized control system generally designated by the numeral 170. The computerized control system 170 includes a computer 172 and associated monitor 174, input/output devices 176 and storage device 178. The control system 170 has associated therewith a vacuum pressure sensor 180 and a temperature sensor 182 which are located within the centrifuge 10 for monitoring the conditions inside the centrifuge 10. The sensors 180 and 182 may be located at any of a variety of locations within the centrifuge 10, including for instance on the underside of lid 48 as schematically illustrated in FIG. 1. As further described below, the computer 172 controls the various manifold valves, pumps, motors, actuators and the like in response to various monitored parameters such as the vacuum pressure and temperature within the centrifuge 10, and in response to a programmed operating cycle.

As also further described below, control system 170 can affect variable speed control of the centrifuge 10 so that controlled low speed spins allow for the removal of excess liquid (dewatering) prior to actual extraction of solution that has infiltrated the plant tissue. Further, the controller can affect variable speed control depending upon the type of plant tissue being processed. For instance, a leafy material such as tobacco requires g forces as set forth in U.S. Pat. No. 6,384,875, but a more fibrous material, such as corn stalks, wheat stalks or rice stalks might require a greater g force to release the infiltrated buffer solution and material of interest. Further, for a plant material that is more fragile, a lower g force may be all that is required to release the infiltrating buffer solution and material of interest.

The control system 170 also provides variable vacuum pressure control. For some extraction processes, a total vacuum in the bowl 12 is desirable, but for other extraction processes, only a partial vacuum is necessary. Such considerations are dependent upon the plant tissue, the ability of a buffer solution to infiltrate tissue, the extent of buffer solution infiltration necessary to acquire the desired molecules, etc.

Figure 5:
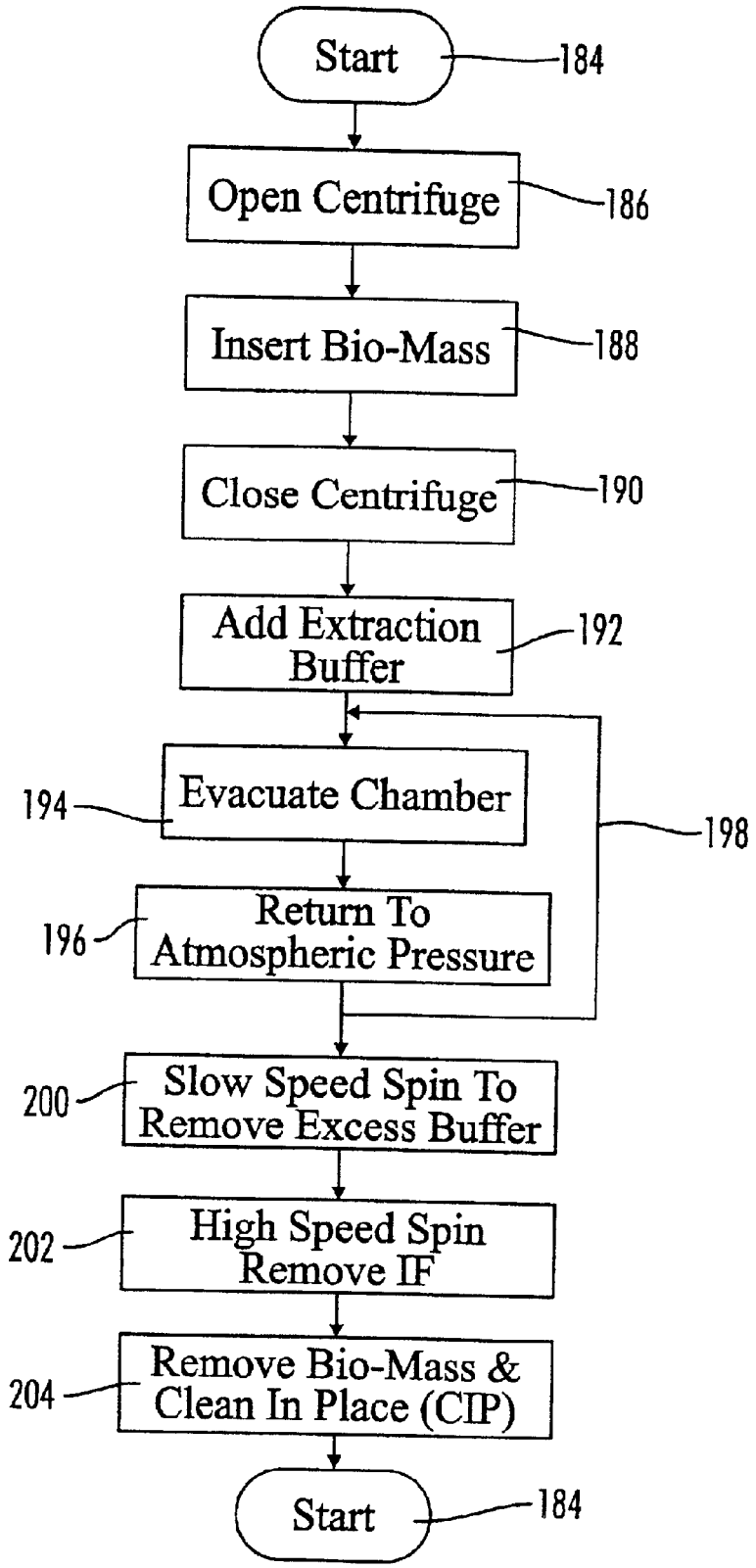
FIG. 5 is a flow chart showing an example of operational steps controlled by the computer of FIG. 4 for cleaning of the centrifuge.

Referring now to FIG. 5, an example of the operational steps involved in the operation and subsequent cleaning of the centrifuge 10 are illustrated in flow chart format.

Beginning with the start block 184 the centrifuge 10 is next opened as indicated by block 186.

Then as indicated by block 188, a mesh bag or bags filled with biomass such as tobacco leaves or other product-laden material is inserted into the cavity 36 of centrifuge bowl 12.

Then as indicated by block 190 the lid 48 is closed and sealed. All valves at this stage are in a closed setting.

Next as indicated by block 192, extraction buffer solution from tank 136 is provided via control of the first manifold valve 132 by computer 172 to allow buffering solution to flow through conduits 138 and 140 and inlet 78 into the interior of centrifuge bowl 12.

After the buffering solution is added, the first manifold valve 132 is reset to allow vacuum to be drawn via vacuum pump 130, as indicated by block 194. The control system 170 and centrifuge 10 can achieve vacuum down to 760 mm (0 psi) or absolute vacuum if required for extraction. The number 760 mm corresponds to a scale provided with most off the shelf vacuum measuring gauges where 0 mm indicates ambient air pressure and 760 mm indicates a total vacuum within the vessel. Therefore, 760 mm would correspond to an air pressure measurement of 0 psi.

Then as indicated by block 196 the pressure within the centrifuge 10 is returned to atmospheric pressure. Then as indicated by loop 198 the evacuation process and return to atmospheric pressure of blocks 194 and 196 may be repeated as many times as desired to ensure penetration of the buffering solution into the bio-mass.

Next as indicated by block 200, the centrifuge 10 is spun at a slow speed sufficient to force fluid up the sides of the bowl 12, in order to remove as much of the buffer solution as possible. This can be referred to as a dewatering step. During the slow speed spin, the fifth manifold valve 162 is set to allow the buffering solution to exhaust to the waste drain pipe 164. The liquid could also be recycled.

Next as indicated by block 202, the fifth manifold valve 162 is reset to direct the interstitial fluid through conduit 166 to storage tank 168 as the centrifuge 10 is spun at a high rate of speed sufficient to extract those fluids which infiltrated the plant tissue.

Finally, as indicated at block 204, the centrifuge is stopped, the lid 48 is opened, the bio-mass is removed, and the centrifuge is cleaned in place.

The cleaning of the centrifuge will result from alternating spraying of wash fluid from tank 142 and rinse fluid from tank 144 through the various nozzles 86, 96, 98, 102 and 110 via control of control system 170, manifold valve 146 and manifold valve 158.

After the centrifuge 10 is cleaned, the process returns to the start block 184 and may be repeated.

Thus it is seen that the apparatus and methods of the present invention ready achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A centrifuge apparatus, comprising:

a rotatable centrifuge bowl having a radially outwardly inclined outer wall;

a housing containing the centrifuge bowl;

a first cleaning nozzle disposed in the housing and directed toward the centrifuge bowl for cleaning the centrifuge bowl; and wherein, the centrifuge bowl is generally toroidal in shape having a radially inner exterior wall;

the centrifuge bowl includes an upward facing cupped surface closing an upper end of the radially inner exterior wall, the cupped surface having a plurality of apertures therethrough; and said first cleaning nozzle is directed into the cupped surface so that cleaning fluid may flow from said first cleaning nozzle through the apertures to clean an exterior surface of the radially inner exterior wall of the centrifuge bowl.

2. The apparatus of claim 1, wherein:

the centrifuge bowl includes an interior bowl surface and an exterior bowl surface; and said centrifuge apparatus further includes second and third cleaning nozzles directed toward the interior and exterior bowl surfaces respectively.

3. The apparatus of claim 2, wherein:

the housing includes a drain outlet for draining cleaning fluid from the housing.

4. The apparatus of claim 1, wherein:

the outer wall of the centrifuge bowl is spaced from the housing to define an annular clearance between the housing and the centrifuge bowl; and another cleaning nozzle is directed toward said annular clearance.

5. A centrifuge apparatus comprising:

a rotatable centrifuge bowl having a radially outwardly inclined outer wall;

a housing containing the centrifuge bowl; and a central vertical support shaft;

wherein the centrifuge bowl includes a radially inner upwardly tapered structural wall for supporting the centrifuge bowl from the support shaft, the radially inner upwardly tapered structural wall having a radially innermost surface defining a downward facing radially inner exterior tapered surface of the centrifuge bowl;

the outer wall of the centrifuge bowl being spaced from the housing to define an annular clearance between the housing and the centrifuge bowl;

a first cleaning nozzle directed toward an interior of the centrifuge bowl;

a second cleaning nozzle which communicates cleaning fluid to the downward facing radially inner exterior tapered surface of the centrifuge bowl; and a third cleaning nozzle directed toward the annular clearance between the housing and the centrifuge bowl.

6. A centrifuge apparatus, comprising:

a rotatable centrifuge bowl;

a vacuum sealable housing, containing the rotatable centrifuge bowl, so that a material of interest contained in the centrifuge bowl can be subjected to vacuum; and a cleaning nozzle disposed in the housing and directed so as to clean the centrifuge bowl, and wherein the centrifuge bowl is generally toroidal in shape having a radially inner exterior wall;

the centrifuge bowl includes an upward facing cupped surface closing an upper end of the radially inner exterior wall, the cupped surface having a plurality of apertures therethrough; and said cleaning nozzle is directed into the cupped surface so that cleaning fluid may flow from the cleaning nozzle through the apertures to clean an exterior surface of the radially inner exterior wall of the centrifuge bowl.

7. The apparatus of claim 6, wherein:

said centrifuge bowl is spaced from the housing to define an annular clearance between the housing and the centrifuge bowl;

and said apparatus further comprising:

a second cleaning nozzle directed toward an interior of the centrifuge bowl; and a third cleaning nozzle directed toward the annular clearance between the housing and the centrifuge bowl.

8. The apparatus of claim 7, wherein:

the housing includes a drain outlet for draining cleaning fluid from the housing.

9. The apparatus of claim 6, wherein:

the centrifuge bowl is spaced from the housing to define an annular clearance between the housing and the centrifuge bowl; and further comprising:

another cleaning nozzle is directed toward said annular clearance.

10. A centrifuge apparatus comprising:

a rotatable centrifuge bowl;

a vacuum sealable housing, containing the rotatable centrifuge bowl, so that a material of interest contained in the centrifuge bowl can be subjected to vacuum; and a plurality of cleaning nozzles disposed in the housing and directed so as to clean the centrifuge bowl.

a central vertical support shaft;

wherein the centrifuge bowl includes a radially inner upwardly tapered structural wall for supporting the centrifuge bowl from the support shaft, the radially inner upwardly tapered structural wall having a radially innermost surface defining a downward facing radially inner exterior tapered surface of the centrifuge bowl;

the centrifuge bowl being spaced from the housing to define an annular clearance between the housing and the centrifuge bowl; and said plurality of cleaning nozzle includes;

a first cleaning nozzle directed toward an interior of the centrifuge bowl;

a second cleaning nozzle which communicates cleaning fluid to the downward facing radially inner exterior tapered surface of the centrifuge bowl; and a third cleaning nozzle directed toward the annular clearance between the housing and the centrifuge bowl.

11. A method for recovery of a material of interest from the interstitial fluid of plant tissues comprising the steps of:

(a) placing the plant tissue in a centrifuge;

(b) sealing the centrifuge;

(c) introducing a buffering solution into the centrifuge;

(d) creating a vacuum in the centrifuge and thereby allowing the buffering solution to infiltrate the plant tissue;

(e) rotating the centrifuge and thereby drawing the buffering solution and the material of interest out of the centrifuge; and (f) retaining the buffering solution and the material of interest.

12. The method of claim 11, further comprising:

repeating steps (c) and (d) prior to step (e).

13. The method of claim 11, wherein:

in step (a) the plant tissue is first placed in a mesh bag and the mesh bag is placed in the centrifuge.

14. The method of claim 13, wherein the mesh bag is annular in shape, and the mesh bag is placed in an annular bowl of the centrifuge.

15. The method of claim 11, further comprising after step (d):

removing the plant tissue from the centrifuge; and automatically cleaning the centrifuge.

16. The method of claim 11, further comprising prior to step (e), rotating the centrifuge at a predetermined slower rate sufficient to remove portions of the buffering solution that did not infiltrate the plant tissue, the slower rate being slower than a rate at which the centrifuge is rotated in step (e).

17. A centrifuge apparatus, comprising:

an annular centrifuge bowl having a radially outer exterior wall and a radially inner exterior wall, the radially inner exterior wall having an exterior surface defining a central space exterior of the bowl;

a receptacle located above the central space, the receptacle having at least one opening communicated with the central space; and a source of cleaning fluid communicated with the receptacle, so that cleaning fluid can flow from the receptacle through the at least one opening and onto the exterior surface of the radially inner exterior wall to clean the exterior surface.

18. The apparatus of claim 17, wherein the receptacle is attached to the centrifuge bowl for rotation therewith.

19. The apparatus of claim 17, wherein:

the receptacle includes a bottom and an outer receptacle wall surrounding the bottom.

20. The apparatus of claim 19, wherein the outer receptacle wall extends upward from the radially inner exterior wall of the centrifuge bowl.

21. The apparatus of claim 20, wherein the opening of the receptacle is located closely adjacent the outer receptacle wall.

22. The apparatus of claim 17, wherein the opening is an elongated passage oriented parallel to an axis of rotation of the bowl.

23. The apparatus of claim 17, wherein the opening is an elongated passage oriented at an acute angle to an axis of rotation of the bowl.

24. The apparatus of claim 17, wherein the radially inner exterior wall is an upwardly inwardly sloped wall.

25. A self-cleaning centrifuge apparatus, comprising:

a rotatable centrifuge bowl including a radially inner exterior wall, and including an upward facing cupped surface closing an upper end of the radially inner exterior wall, the cupped surface having a plurality of apertures therethrough; and at least one cleaning nozzle directed into the cupped surface so that cleaning fluid may flow from the at least one cleaning nozzle through the apertures to clean an exterior surface of the radially inner exterior wall of the centrifuge bowl.

26. The apparatus of claim 25, wherein:

the plurality of apertures includes a first plurality of vertically oriented apertures spaced circumferentially around the cupped surface, and a second plurality of inclined apertures spaced circumferentially around the cupped surface.

27. The apparatus of claim 25, wherein:

the radially inner exterior wall is frusto-conically shaped; and the plurality of apertures are arranged to sling cleaning fluid by centrifugal force onto the radially inner exterior wall when the centrifuge bowl is rotated.

28. A method for recovery of a material of interest from the interstitial fluid of plant tissues comprising the steps of:

(a) placing the plant tissue in a mesh bag and placing the mesh bag in a centrifuge;

(b) sealing the centrifuge;

(c) introducing a buffering solution into the centrifuge;

(d) creating a vacuum in the centrifuge and thereby allowing the buffering solution to infiltrate the plant tissue; and (e) rotating the centrifuge and thereby drawing the buffering solution and the material of interest out of the centrifuge.

29. The method of claim 28, wherein the mesh bag is annular in shape, and the mesh bag is placed in an annular bowl of the centrifuge.

* * * * *